US005663754A

United States Patent [19]

Lorenze, Jr. et al.

[11] Patent Number: 5,663,754

[45] Date of Patent: Sep. 2, 1997

[54] METHOD AND APPARATUS FOR REFILLING INK JET CARTRIDGES

[75] Inventors: Robert V. Lorenze, Jr., Webster; Renato P. Apollonio, Rochester, both of N.Y.

[73] Assignee: Xerox Corporation, Stamford, Conn.

[21] Appl. No.: 523,582

[22] Filed: Sep. 5, 1995

[51] Int. Cl.[6] ..... B41J 2/175

[52] U.S. Cl. ..... 347/87

[58] Field of Search ..... 347/84–87, 30, 347/29, 23

[56] References Cited

U.S. PATENT DOCUMENTS

| | | | |
|---|---|---|---|
| Re. 32,572 | 1/1988 | Hawkins et al. | 156/626 |
| 4,383,263 | 5/1983 | Ozawa et al. | 347/30 |
| 4,422,084 | 12/1983 | Saito | 347/86 |
| 4,558,326 | 12/1985 | Kimura et al. | 347/30 |
| 4,628,333 | 12/1986 | Terasawa | 347/87 |
| 4,631,556 | 12/1986 | Watanabe et al. | 347/30 |
| 4,638,337 | 1/1987 | Torpey et al. | 347/65 |
| 4,774,530 | 9/1988 | Hawkins | 347/63 |
| 4,968,998 | 11/1990 | Allen | 347/7 |
| 5,136,305 | 8/1992 | Ims | 347/7 |
| 5,199,470 | 4/1993 | Goldman | 141/1 |
| 5,280,299 | 1/1994 | Saikawa et al. | 347/87 |
| 5,329,294 | 7/1994 | Ontawar et al. | 347/87 |
| 5,365,645 | 11/1994 | Walker et al. | 29/25.35 |
| 5,369,429 | 11/1994 | Erickson | 347/7 |

*Primary Examiner*—Benjamin R. Fuller
*Assistant Examiner*—Judy Nguyen

[57] ABSTRACT

A method and apparatus is provided for refilling an ink reservoir associated with an ink jet printhead. A refill ink source is brought into sealing engagement with the front nozzle face of the printhead. Ink from the refill reservoir is forced into the printhead nozzles and flows through the nozzle channels back into the reservoir. The refill operation can be enabled by establishing a pressure gradient against the refill ink supply forcing it through a pressure regulating drive seal, or a filter, into the nozzles. Alternatively, a vacuum is established through a vent tube to the cartridge reservoir creating a negative differential at the vent hole and causing the ink from the refill container to pass through the nozzles into the supply reservoir.

10 Claims, 4 Drawing Sheets

METHOD AND APPARATUS FOR REFILLING INK JET CARTRIDGES

BACKGROUND OF THE INVENTION AND MATERIAL DISCLOSURE STATEMENT

The present invention relates to an ink jet printer system and, more particularly, to a means and method for refilling an ink jet cartridge which supplies ink to an ink jet printhead.

Ink jet printers, or plotters, of the so-called "drop-on-demand" type have at least one printhead from which droplets of ink are directed towards a recording medium. Within the printhead, the ink is contained in a plurality of channels and energy pulses are applied to transducers to cause the droplets of ink to be expelled, as required, from nozzles at the ends of the channels.

In a thermal ink jet printer, the energy pulses are usually produced by resistors, which are individually addressable by current pulses to heat and vaporize ink in a channel or recess proximate to the nozzle. As a vapor bubble grows, ink bulges from the nozzles until the current pulse has ceased and the bubble begins to collapse. At that stage, the ink within the channel or recess retracts and separates from the bulging ink which forms a droplet moving in a direction away from the nozzles and towards the recording medium. The channel or recess is then re-filled by capillary action, which in turn draws ink from a supply cartridge. Operation of a thermal ink jet printer wherein the ink is expelled from channels is described in, for example, U.S. Pat. Nos. 4,638,337 and 4,774,530, which disclose a printer of the carriage type having a plurality of printheads, each with its own ink supply reservoir, mounted on a reciprocating carriage. The nozzles of each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

Many current ink jet printers and plotters utilize disposable printhead cartridges which incorporate self-contained ink supplies. However, the current printhead technology has advanced to the point where the lifetime and reliability of the structural components of the printhead, such as the resistive heater elements, far exceed the usage life of the self-contained ink supply. For example, for a Xerox 4004 printhead, the standard ink charge will last for $5\times10^6$ pulses per jet while the heater reliability includes minimum lifetimes in excess of $5\times10^7$ pulses per jet. Thus, it is seen that discarding an ink cartridge supply because it's ink charge has been expended is wasteful and environmentally unfriendly.

The need for refilling ink jet cartridges to exceed lifetime is therefore well recognized and several methods and devices have been presented to accomplish this. One approach is to connect a second auxiliary ink reservoir to a main printhead cartridge to provide a continuous resupply during operation. U.S. Pat. No. 5,369,429 discloses this technique.

Other techniques are directed to removing the ink cartridge from the system and refilling through either an already existing vent hole by means of an ink-filled syringe or by using a special tool to form a new, or enlarge an existing, vent hole. The cartridge is then refilled by means of a tube or syringe from an auxiliary supply. Disclosures of this type of refill are found in U.S. Pat. Nos. 5,199,470 and 5,329,294.

U.S. Pat. No. 4,968,998 discloses refill of a cartridge without removing the cartridge from the printhead by moving the printhead to a service station and inserting a refill tube into an aperture in the cartridge body.

The above techniques are not suitable for many types of printheads and printing systems. For example, many cartridges contain the ink in a collapsible bag so penetration of the cartridge with a syringe or refill tube would puncture the bag. Further, some ink cartridges have venting tubes which are either inaccessible or which, once modified, must be restored for the original venting purpose.

SUMMARY OF THE INVENTION

It is an object of the present invention to provide a means and method for refilling ink jet cartridges with different types of ink-holding interior receptacles.

It is a further object to enable a cartridge refill manually at a remote location.

It is a further object to provide a refill kit for refilling an ink-depleted cartridge. These and other objects of the invention are realized by establishing a refill operation through the nozzle face of the printhead. A source of refill ink is sealingly attached to the printhead nozzle face. A vacuum or a pressure is applied to force the refill ink through the nozzles and back into the ink supply. In one embodiment, an ink cartridge at a remote location is refilled through the printhead nozzle from a refill reservoir by applying a pressure differential. In another embodiment, the cartridge, at a remote location, is refilled through the printhead nozzle by a vacuum mechanism.

More particularly, the present invention relates to an ink refill system for an ink jet printer comprising:

- a printhead having a plurality of nozzles for ejecting ink therefrom,
- an ink supply reservoir,
- means for supplying ink from said reservoir to said printhead,
- a refill source of ink available for refilling said ink supply reservoir after an initial ink supply is reduced or depleted,
- means for fluidly connecting said refill ink source to said nozzles and
- means for causing ink from said refill ink source to flow through said nozzles into said ink supply reservoir.

DESCRIPTION OF THE INVENTION

Figure 1:
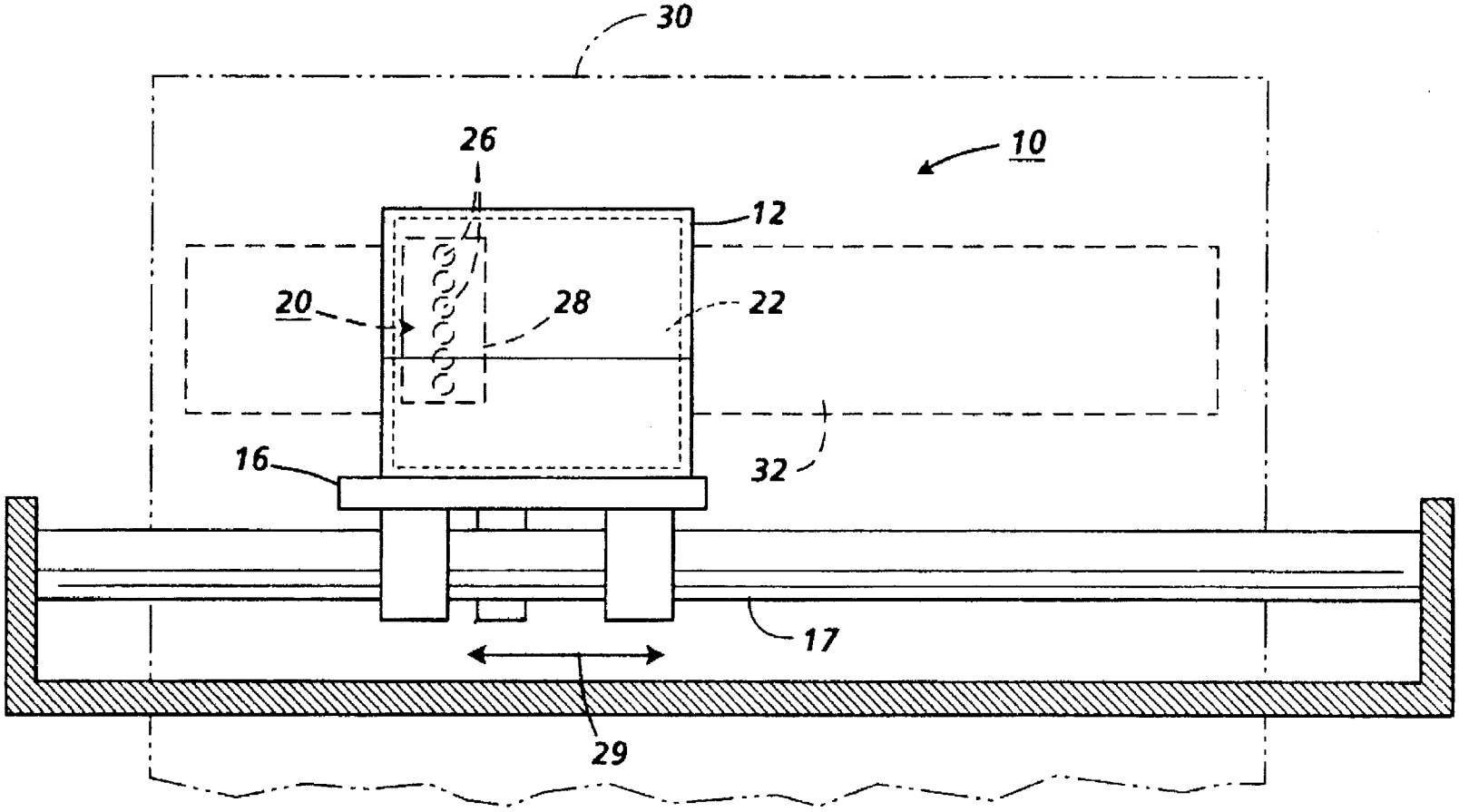
FIG. 1 is a schematic view of an ink jet printing system which can utilize a refill station of the invention.

FIG. 1 shows an embodiment of a thermal ink jet printer 10 for which the refill system of the present invention can be utilized. Printer 10 includes a printhead cartridge 12 mounted on a scanning carriage 16, translatable back and forth on guide rails 17. Cartridge 12 comprises a printhead 20 and an integral ink supply reservoir 22, which can be filled with ink or with an ink impregnated foam material. Formed within the printhead are a plurality of ink channels, each with a resistive heater, continuously supplied with ink from the reservoir through a printhead fill hole. The ink channels terminate in nozzles 26 in nozzle face 28. In use, the scanning carriage 16 reciprocates, in the direction of arrow 29, and resistor heaters are selectively energized causing droplets of ink to be expelled through printhead nozzles. The droplets are directed towards the recording medium 30 along a printing zone or swath 32. During each pass of the scanning carriage, the recording medium is stationary. At the end of each pass, the recording medium 30 is stepped up to the next print line. Further details of a printing system 10 are found in U.S. Pat. No. 4,638,337 and Reissue No. 32,572, whose contents are hereby incorporated by reference. It is understood that the invention is applicable to other types of ink jet printing systems and is not limited solely to the embodiment described herein and in connection with said patents.

According to a first embodiment of the invention, cartridge 12 is refilled by being manually removed from the printer carriage mounting and taken to a remote refill location wherein ink refill apparatus 40 is located.

Figure 2:
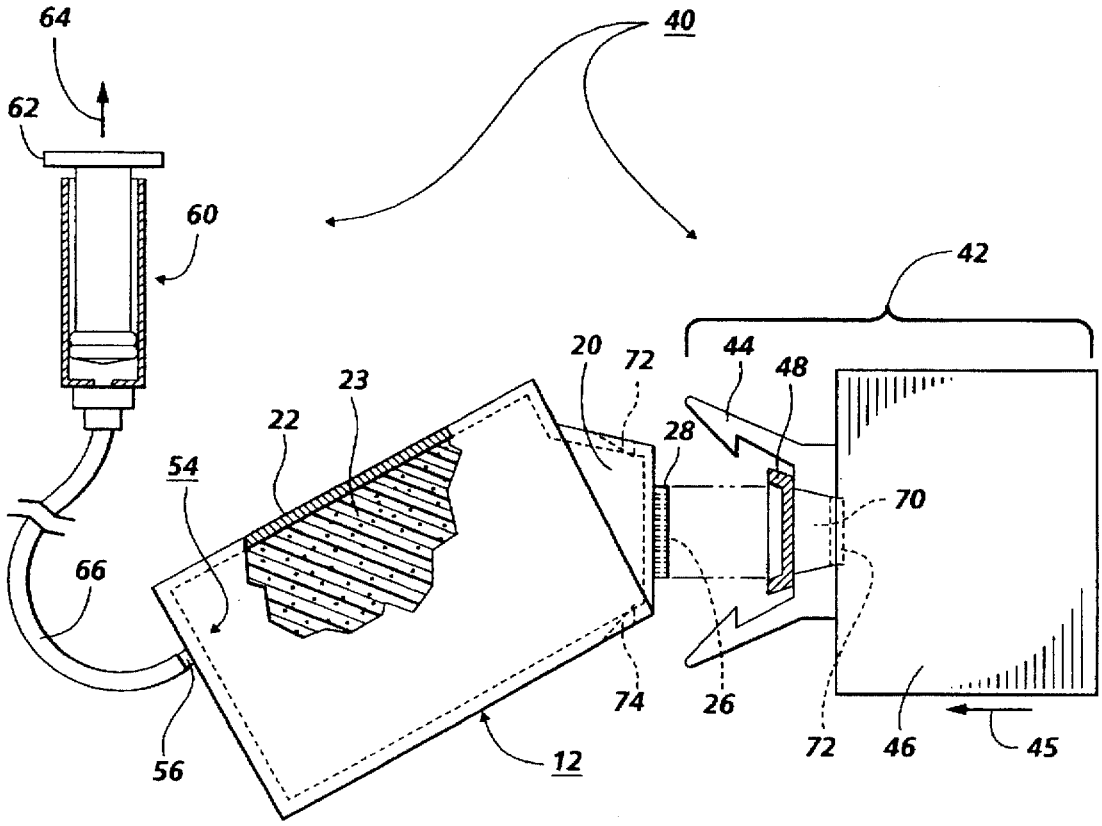
FIG. 2 is a schematic end view of the printing cartridge removed from the printing system of FIG. 1 in a first embodiment of the refill apparatus.

FIG. 2 shows a schematic end View of a first embodiment wherein reservoir 22 of cartridge 12 is refilled through the nozzles 26 of the printhead. FIG. 2 shows the cartridge 12 held in a position prior to engagement with a refill assembly 42. Assembly 42 includes a mechanical clamping mechanism 44, a refill ink container 46 and a flexible, compressible gasket 48 which interfaces with the surface of nozzle face 28 and encompasses nozzles 26. Cartridge 12 includes printhead 20 which has a plurality of nozzles 26 formed along nozzle face 28. Ink reservoir 22 holds a quantity of ink incorporated with a foam member 23. Reservoir 22 is hermetically sealed within the cartridge under a slight negative pressure. The ink flow is in conventional fashion and by capillary action through a fill hole and into ink channels formed in printhead 20. Each ink channel contains a resistor which is selectively energized causing ink to be heated and expelled through the nozzle. The channels continually refill after each ink expulsion. The atmospheric pressure within the reservoirs is maintained through a dual function vent 54 formed in a wall of the cartridge and shown in further detail in FIG. 3.

Figure 3:
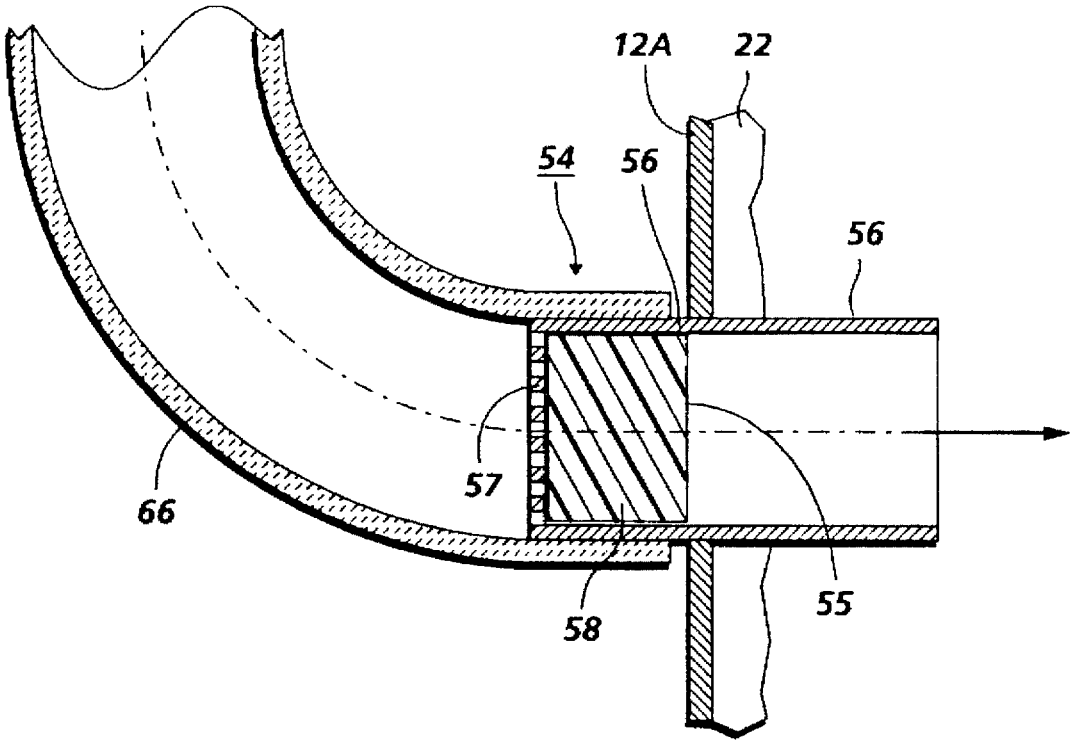
FIG. 3 is an enlarged view of the vent hole of the cartridge shown in FIG. 1.

As shown in FIG. 3, vent 54 has an aperture 55 formed within a wall 12*a* of cartridge 12. A vent tube 56 is inserted in aperture 55 with one end extending into reservoir 22 and the other end extending slightly beyond wall 12A into the ambient. Vent tube 56 has a perforated end cap 57 to permit air flow and contains a barrier member 58 which can be Gortex® or similar material which permits the passage of air but prevents liquid ink flow out of the cartridge under normal operating conditions.

Continuing with a description of FIG. 2, gasket 48 interfaces with the surface of nozzle face 28 and encompasses nozzles 26, when the assembly 42 is manually moved in the direction of arrow 45 into sealing contact with the printhead. Apparatus 40 further includes a vacuum assembly 60 which may be a syringe-type vacuum suction mechanism 60. Mechanism 60 is connected to reservoir 22 by means of flexible tube 66 which is attached to the end of vent tube 56.

In a preferred embodiment, clamping mechanism 44 is an inexpensive molded plastic component. Gasket 48 is a molded elastomer material such as silicone which, under mechanical clamping pressure, forms a leak-proof seal with the nozzle face region of the printhead. Container 46 would hold the desired volume of refill ink which would optimally allow the ink to flow through a restricted aperture 70 and a filter 72.

In operation and referring to FIGS. 1–3, a decision is made to initiate a refill operation. This may be made by an operator or automatically, for example, by an ink level monitoring system of the type disclosed in U.S. Pat. No. 5,136,305, whose contents are hereby incorporated by reference. A signal is generated to create a display on an indicator indicating that ink refill is required. The operator removes the cartridge to the remote location and moves assembly 42 so that clamping mechanism 44 engages notches 72, 74 of cartridge 12 and gasket 48 is sealed over the nozzle face plate 28. Tube 66 is then connected to vent tube 56 of cartridge 12 and the plunger 62 of the syringe is withdrawn in the direction of arrow 64 so that (negative) vacuum pressure through the vent tube 56 is applied to the cartridge reservoir sufficient to draw ink from container 46 through nozzle 26. A vacuum of 200–250 Torr has been found to produce satisfactory results.

As ink begins to flow from container 46 through nozzles 26, the ink flows in a path opposite to the capillary flow of ink during normal operation; e.g. the ink flows through ink channels and begins to refill reservoir 22. The refill operation continues until the reservoir is filled to the desired level at which time tube 66 is removed.

The clamping mechanism is then retracted and assembly 42 is moved out of sealing engagement with the printhead nozzle face 28. The cartridge is then restored to the normal operating location on carriage 16.

While the FIG. 2–3 embodiment refills the reservoir by creating a vacuum to establish a negative pressure at vent 54 of the cartridge, an alternative technique for moving the ink from refill container 46 is to force the ink from the container into the nozzles by directly applying pressure against the ink in the container.

Figure 4:
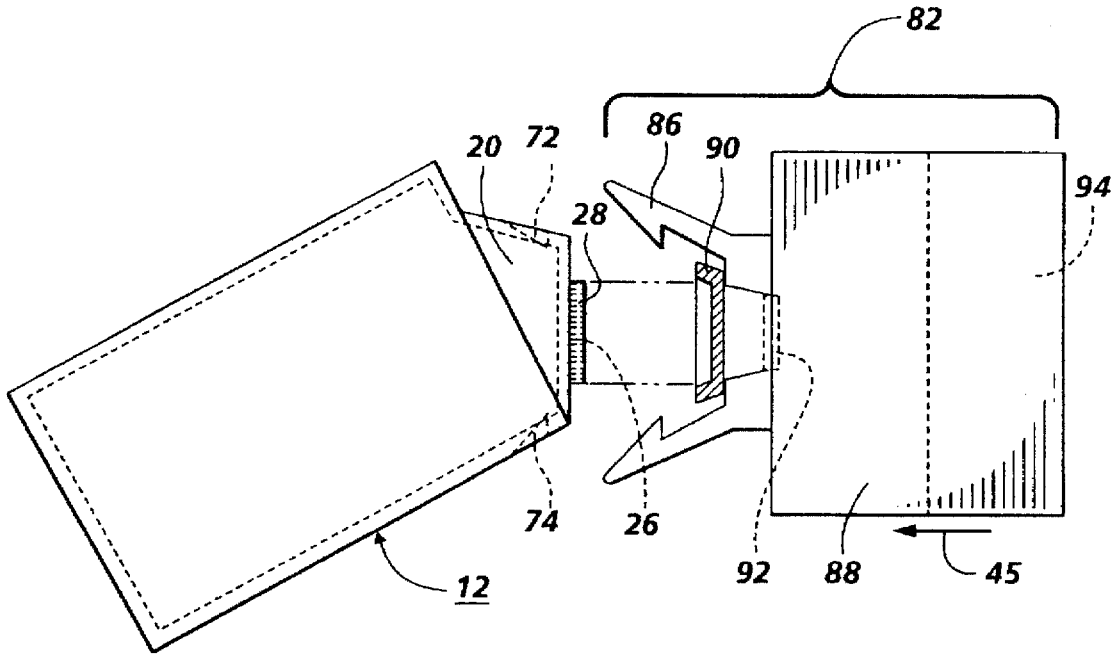
FIG. 4 is a cross-sectional end view of a second embodiment of the refill station.

FIG. 4 shows a second embodiment of the invention. FIG. 4 shows a side end view of cartridge 12 after it has been removed from carriage 16 and carried to the remote refill location where ink refill apparatus 82 is located.

Refill apparatus 82 includes a mechanical clamp mechanism 86, a refill ink container 88, and a flexible compressible gasket 90, an ink filter 92 and a pressure mechanism 94. Clamping mechanism 86, container 88, and gasket 90 are similar in construction and operation to mechanism 44, container 46 and gasket 48, shown in the FIG. 2 embodiment. Mechanism 94, in this embodiment, is a pressure pump but can be any mechanical, chemical or fluidic means for exerting pressure on the ink in container 88. Mechanism 94 is activated after the clamping mechanism is in place. The flow of ink from the container 88 into the nozzles would be restricted by filter 92. Alternatively, filter 92 may be replaced by an aperture plate or by another pressure regulating mechanism to prevent gasket seal leaks from developing and to control gas bubbles from being introduced into the cartridge. In one controlled experiment, a pressure of about 1–2 psi was applied against the ink in container 88. Within one minute, 60 mm of ink flowed from the container through the nozzles and into the reservoir. This pressure method is useful for those configurations which have inaccessible reservoir venting holes, thus preventing the vacuum method from being applied or for reservoirs with ink in a leak-proof collapsible bag configuration.

To summarize the refill operation of the present invention, a printhead cartridge is taken to a refill station where a refill container is brought into a sealing relationship with the nozzle face of the printhead. Ink from the refill reservoir is introduced into the printhead reservoir via the nozzles using either a vacuum (FIG. 3) or pressure (FIG. 5) mechanism to create the reverse ink flow. The refill operation was described with respect to an ink cartridge which included a printhead with separate channels supplying ink to associated nozzles, each channel having resistive heater plates therein. The invention is applicable to other types of printhead configurations with the minimum structure of having nozzles to which ink held in a recess or series of channels and supplied from an ink reservoir is selectively heated to expel ink droplets from the nozzle. As an example, U.S. Pat. No. 5,365,645 discloses a piezoelectric type of printhead having nozzles through which ink is expelled. The invention is intended to include other such modifications.

While the embodiment disclosed herein is preferred, it will be appreciated from this teaching that various alternative, modifications, variations or improvements therein may be made by those skilled in the art, which are intended to be encompassed by the following claims:

We claim:

1. An ink refill system for an ink jet printer comprising:

a printhead having a plurality of nozzles formed in a nozzle face of the printhead for ejecting ink therefrom, an ink supply reservoir, means for supplying ink from said reservoir to said printhead, a refill source of ink available for refilling said ink supply reservoir after an initial ink supply is reduced or depleted, means for fluidly connecting said refill ink source to said nozzles in said nozzle face and means for causing ink from said refill ink source to flow through said nozzles into said ink supply reservoir.

2. The refill system of claim 1, wherein said means for causing ink to flow from said refill ink source through said nozzles into said reservoir includes means for exerting pressure on the refill ink source.

3. The refill system of claim 1, wherein said printhead and ink supply reservoir are formed within an ink cartridge, the cartridge having a vent hole and wherein the means for causing ink to flow through said nozzles includes means for creating a vacuum to establish a negative pressure at said vent hole.

4. A refill system for an ink jet printing system wherein a printhead and associated ink supply reservoir is moved on a carriage across printing zone with ink being ejected from nozzles formed in a nozzle face of the printhead, the system including:

a refill ink container, a clamping mechanism for clamping the refill ink container to the nozzle face of the printhead, a gasket forming a sealing contact with a perimeter of the nozzle face when the refill ink container is clamped to the nozzle face and means for moving the ink from the refill ink container through the nozzles of the printhead and into the ink supply reservoir thereby refilling the reservoir.

5. The system of claim 4, wherein said means for moving the ink is a source of pressure applied against the ink in the refill container so as to force the ink through said nozzles.

6. The system of claim 4, wherein said ink supply reservoir includes a vent hole and wherein said means for moving the ink includes means for creating a vacuum to establish a negative pressure at said vent hole.

7. The system of claim 4, wherein said reservoir includes an ink sensor for detecting a low level of ink and for generating a signal used to initiate a refill operation.

8. A method for refilling an ink reservoir associated with an ink jet printhead wherein ink from the reservoir is carried by capillary action into heater channels formed within the printhead and ejected as droplets through nozzles on a front face of the printhead, the method including the steps of:

establishing a sealing interface between a source of refill ink and the front face of said printhead and forcing the ink from said refill ink source through the nozzles on said front face and into said reservoir for a period of time sufficient to refill the reservoir.

9. An ink refill kit for refilling an ink reservoir fluidly connected to an ink jet printhead, the reservoir and printhead forming an ink cartridge, the kit comprising:

a refill container of ink available for refilling said ink supply reservoir after an initial ink supply is reduced or depleted, a clamping mechanism for clamping the refill container to nozzles formed in a nozzle face of the printhead, a gasket forming a sealing contact with a perimeter of the nozzle face when the refill container is clamped to said nozzles and a vacuum connected to a vent hole formed in the cartridge to establish a negative pressure at said vent hole so as to cause the ink from said refill ink container to flow through said nozzles.

10. An ink refill kit for refilling an ink reservoir fluidly connected to an ink let printhead, the reservoir and printhead forming an ink cartridge, the kit comprising:

a refill container of ink available for refilling said ink supply reservoir after an ink supply is reduced or depleted, a clamping mechanism for clamping the refill container to nozzles formed in a nozzle face of the printhead, a gasket forming a sealing contact with a perimeter of the nozzle face when the refill container is clamped to said nozzles and a source of pressure applied against the ink in the refill container so as to force the ink through said nozzles.

* * * * *